US005366070A

United States Patent [19]

Wolov

[11] Patent Number: 5,366,070

[45] Date of Patent: Nov. 22, 1994

[54] ARTICLE HOLDING KIT

[76] Inventor: Samantha E. Wolov, 3607 Husted Dr., Chevy Chase, Md. 20815

[21] Appl. No.: 267,751

[22] Filed: Jul. 5, 1994

[51] Int. Cl.[5] ..... B65D 71/00

[52] U.S. Cl. ..... 206/214; 206/224; 206/371; 206/460; 206/818; 224/183; 224/901; 248/205.2; 248/206.5

[58] Field of Search ..... 281/15.1, 29, 30, 34; 206/214, 224, 225, 371, 460, 495, 472, 473, 806, 813, 818; 224/901, 183; 248/205.2, 206.5

[56] References Cited

U.S. PATENT DOCUMENTS

| | | | |
|---|---|---|---|
| D. 333,485 | 2/1993 | Kogutt . | |
| 2,088,953 | 8/1937 | Greer . | |
| 2,194,003 | 3/1940 | Brooks . | |
| 2,648,366 | 8/1953 | Higbee et al. . | |
| 3,564,668 | 7/1969 | Kirk . | |
| 3,658,365 | 4/1972 | Greubel . | |
| 4,100,684 | 7/1978 | Berger . | |
| 4,306,737 | 12/1981 | Errichiello . | |
| 4,391,457 | 7/1983 | Gassner . | |
| 4,470,620 | 9/1984 | Gerch . | |
| 4,588,209 | 5/1986 | Zebrowski et al. . | |
| 4,682,691 | 7/1987 | Spiering | 206/813 X |
| 4,831,756 | 5/1989 | Huang et al. . | |
| 4,973,177 | 11/1990 | Rose | 206/224 X |
| 5,018,609 | 5/1991 | Brenner | 206/225 X |
| 5,020,662 | 6/1991 | Aida | 206/224 X |
| 5,050,830 | 9/1991 | Hall | 224/901 X |
| 5,154,391 | 10/1992 | Hegarty | 248/205.2 X |
| 5,163,549 | 11/1992 | Hayduchok . | |
| 5,186,373 | 2/1993 | Taylor | 224/183 |
| 5,242,063 | 9/1993 | Ericksen et al. | 248/205.2 X |

FOREIGN PATENT DOCUMENTS

| | | |
|---|---|---|
| 774664 | 5/1957 | United Kingdom . |
| WO81/00379 | 2/1981 | WIPO . |

*Primary Examiner*—Jacob K. Ackun, Jr.
*Attorney, Agent, or Firm*—Richard C. Litman

[57] ABSTRACT

An article holding kit for detachably securing articles such as writing and drawing utensils as well as an eyeglasses case, including a thin ferrous metal plate having fastening material such as Velcro adhesively attached thereto. The articles to be detachably secured to the holder are themselves equipped with narrow strips of fastening material such that they may be easily secured and removed regardless of their type or dimension. The entire article holder may be itself detachably secured to any flat surface such as a ring binder cover or a desktop that is equipped with thin adhesive magnet strips included with the kit. Once several surfaces are so equipped, the entire article holder may be easily transferred from surface to surface.

5 Claims, 2 Drawing Sheets

ARTICLE HOLDING KIT

BACKGROUND OF THE INVENTION

1. Field of the Invention

The present invention relates to article holders and, more particularly, to an improved eyeglasses and writing or drawing implement holder kit for use with any flat surface, especially the inside cover of a ring notebook.

2. Description of the Prior Art

Article holders have long been used to retain pens, pencils, and the like for convenience in carrying and transporting these articles. In more recent years, such article holders have been used in conjunction with paper organizers such as notebooks, ring binders, and folders so that these articles could be carried along with the paper work contained in the organizer. Although several such article holders have been used, none has been created that is easily transferable and detachably securable to any notebook cover or other flat surface that is also capable of holding diverse articles including writing utensils, scissors, rulers, and eyeglasses. Moreover, no article holder has utilized hook and loop (e.g., Velcro brand) fastening material to individually secure each article, thus allowing for the retention of a multiplicity of articles and/or implements.

As aforementioned, several article holders have been introduced. U.S. Pat. No. 4,306,737 issued Dec. 22, 1981 to Errichiello, shows one such holding means used in conjunction with a three ring binder. On the inside surface of the back cover of the binder, snap-in ribs are provided such that a ruler and two writing utensils may be secured. While these means do secure each implement individually, the article holding structure is integrally molded to the binder cover and, therefore, cannot be removed from the binder. Moreover, retention is limited to securing only a single ruler and two writing utensils of particular dimensions. A further disadvantage of this design is that these molded snap-in ribs are susceptible to breaking or chipping with normal use.

Another article holder is shown in U.S. Pat. No. 3,564,668 issued Jul. 29, 1969 to Kirk. The holder described in this patent again utilizes clips to secure writing utensils. While this holder is transferable to any book cover, notebook cover, sun-visor, or similar plate-like surface, there are several limitations with the design. Similar to the Errichiello patent described above, the utensil holder shown in U.S. Pat. No. 3,564,668 uses clip-like holders that can only house utensils of certain dimensions and that are susceptible to breaking or chipping. Moreover, this utensil holder can only retain pens or pencils; no provision is made for the retention of rulers, scissors, eyeglasses or the like.

U.S. Pat. No. 4,100,684 issued Jul. 18, 1978 to Berger discloses another holder device. In this patent, paper products and a writing utensil may be supported by the holder device. The device itself is provided with a permanent magnet adhesively attached to its back surface. A ferrous metallic bar with an adhesive layer is supplied that may be adhered to a flat surface to which the holder device is to be detachably secured. While this configuration allows the holder device to be detachably secured to any flat ferrous metallic surface, a drawback of this configuration is that only a single writing utensil may be housed in the device. Another disadvantage is that articles held in the device are only supported due to the force of gravity. Therefore, if the device is tipped, as when carried with a notebook, the contents held by the device would spill out.

A similar utensil holder is shown in U.S. Pat. No. 5,163,549 issued Nov. 17, 1992 to Hayduchok in which a holding device is shown adapted to adhere to the inside cover of a attache case with adhesive strips of fastening material such as Velcro. While the device does retain the writing utensils in their places, again, the device is limited to use with writing utensils of particular dimensions, and no place is provided for the retention of other implements useful when writing or drawing.

Other patent references relating to article holders but less relevant to the instant invention include U.S. Pat. No. 2,088,953 issued Aug. 3, 1937 to Greer, U.S. Pat. No. 2,648,366 issued Aug. 11, 1953 to Higbee et al., U.S. Pat. No. 4,391,457 issued Jul. 5, 1983 to Gassner, and U.S. Pat. No. 4,770,620 issued Sep. 11, 1984 to Gerch.

None of the above inventions and patents, taken either singly or in combination, is seen to describe the instant invention as claimed.

SUMMARY OF THE INVENTION

The present invention relates to an improved article holder kit for use with flat surfaces such as ring binder covers. The typical article holder used to retain writing utensils and other related articles comprises either a clip-type friction retainer or a compartmental container. While effectively providing a securing means for such articles, many of these article holders are limited to holding a particular number of articles of a particular type and shape.

Other limitations exist in that many of these article holders are either fixed to a notebook cover itself or simply cannot be transferred to other flat surfaces such as desk-tops or wall surfaces.

Accordingly, it is a principal object of the invention to provide an article holder that may be used to detachably secure pens, pencils, rulers, protractors and the like as well as an eyeglasses case.

It is another object of the invention to provide an article holder that is quickly and easily transferable and detachably securable to nearly any flat surface on which the holder is desired to be placed.

It is a further object of the invention to provide improved elements and arrangements thereof in an apparatus for the purposes described which is inexpensive, dependable and fully effective in accomplishing its intended purposes.

Accordingly, the invention is an article holder kit which comprises a thin rectangular ferrous metal plate to which a patch or several strips of hook and loop fastening material (e.g., Velcro) are adhesively attached along approximately the top two-thirds of the plate. Along with the plate is provided a narrow length of such fastening material having an adhesive backing covered with a release liner. This material is to be cut to appropriate lengths by the user to be adhesively attached to the writing, drawing, and paper working implements desired to be secured to the article holder. In addition, the article holder kit may include basic writing and drawing articles such as a ruler, pen, pencil, and scissors, each pre-fitted with fastening material.

Also included in the kit are several elongated thin strips of permanent magnet. These magnet strips have an adhesive backing, again covered with a release liner. Once a surface is chosen, the user removes the protective layer and adheres the magnet strips to the surface. When the strips are in place, the article holder may be detachably secured to the surface with the attractive magnetic force created between the ferrous metal and the permanent magnets. Enough magnetic strips are included such that several different flat surfaces could be used to anchor the article holder.

Finally, another shortened adhesive magnet strip is supplied that may be adhered to an eyeglasses case or similar article such that the case or similar article can be magnetically secured to the plate along the bottom one-third of the article holder plate.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
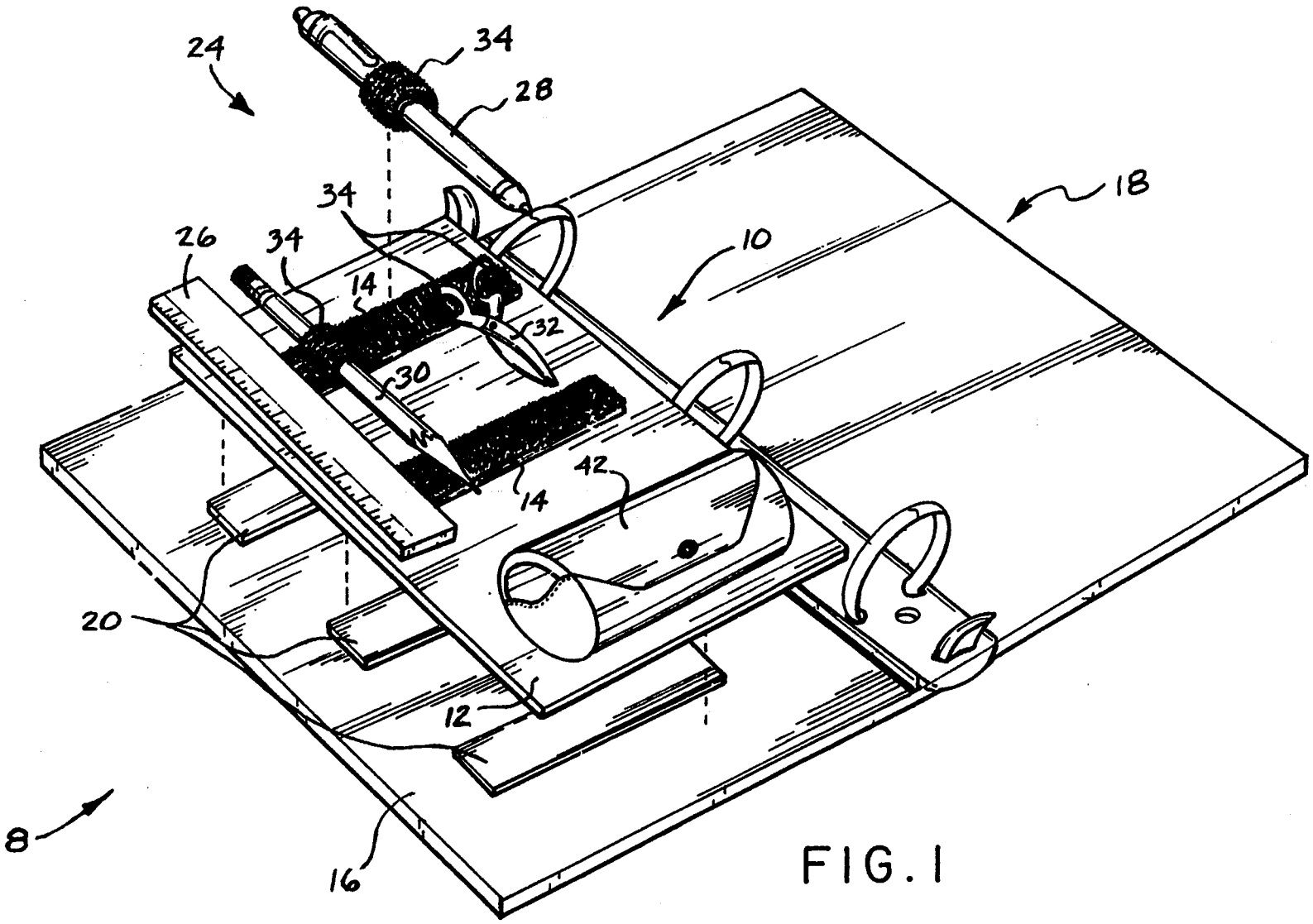
FIG. 1 is an partially exploded environmental view of the kit with articles detachably secured to the article holder.

The present invention is depicted in FIG. 1 which shows the preferred embodiment of the article holder kit, designated generally 8 with articles generally 24 attached thereto, as the article holder 10 would be prior to placement into a standard ring binder 18. The article holder 10 includes a thin ferrous metal plate 12 with strips 14 of hook and loop fastening material such as Velcro attached thereto with an adhesive. However, it will be appreciated that this fastening material could be in the form of either a large rectangular area or a multiplicity of strips. The ferrous metal plate 12 is constructed of iron or steel. If constructed of a material other than rust resistant metal (e.g., stainless steel), the metal plate 12 may be coated with a paint or similar protective coating to impede the formation of rust.

Figure 2:
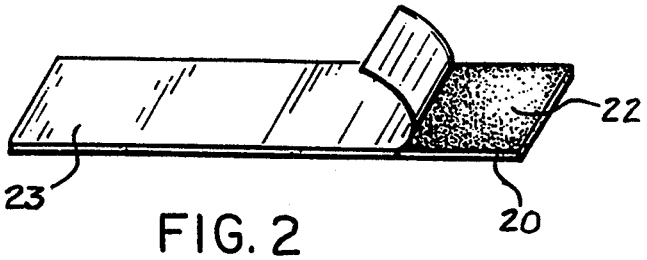
FIG. 2 is a rear perspective view of an adhesive permanent magnet strip.

Shown attached to the inside cover 16 of a standard ring binder 18 are strips 20 of permanent magnet that affix to the cover 16 with adhesive. As depicted in FIG. 2, the magnet strips 20 have an adhesive backing 22 which is covered by a release liner 23 until the strips 20 are to be adhered to the desired surface.

In FIG. 1, attached along the top portion of the plate 12 are several articles denoted generally 24, including a ruler 26, a pen 28, a pencil 30, and a pair of scissors 32. Each article is pre-fitted with a narrow strip of fastening material 34 which adheres to the article with adhesive.

Figure 3:
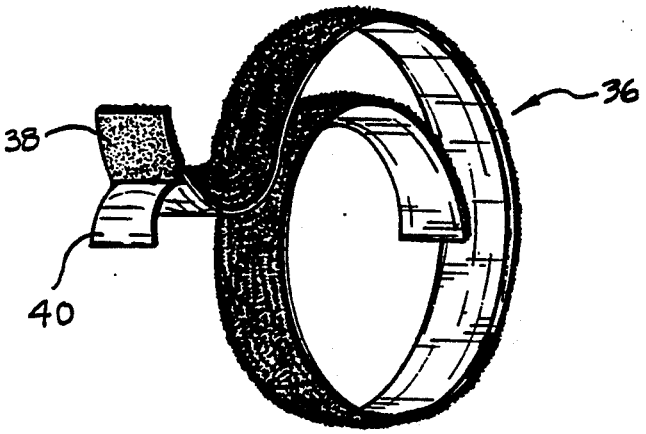
FIG. 3 is a perspective view of a length of adhesive fastening stripping.

Included with the article holder kit 8 is a narrow length of fastening material 36, shown in FIG. 3. This length of material 36 has an adhesive backing 38 covered with a release liner 40 when the portion of the length 36 has not yet been used.

Figure 4:
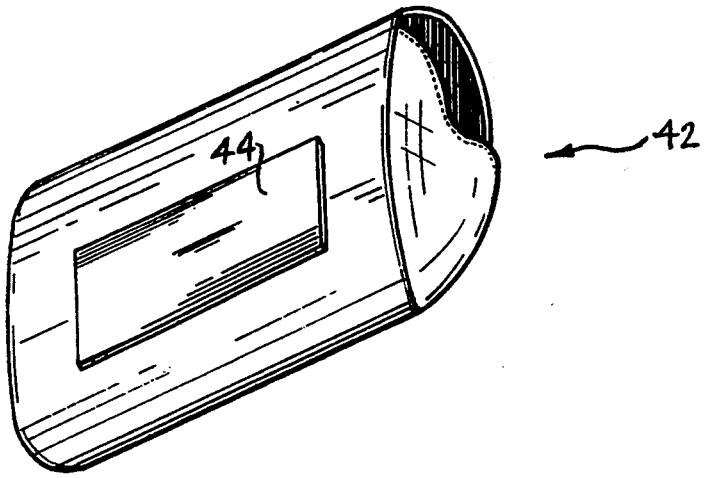
FIG. 4 is a rear perspective view of an eyeglasses case having a magnet strip attached thereto.

Along the bottom section of the metal plate 12 an eyeglasses case 42 is placed. As shown in FIG. 4, the user's own eyeglasses case 42 is fitted with a short length of adhesively attached magnet strip 44.

To use the preferred embodiment shown in FIG. 1, the user need only remove the release liners 24 from the several supplied magnet strips 20 and adhere them to a selected flat surface such as an inside cover of a notebook binder 16. The article holder 10 then may simply be positioned over the strips 20 on the flat surface, held firmly in place by the attractive force between the ferrous metal plate 12 and the magnet strips 20. This attractive force is sufficient to hold the article holder in position against the force of gravity, if placed on a vertical surface, and against jarring forces, if the holder is placed in a notebook binder that is being carried by the user. The attractive force, however, is not so strong as to make the intentional removal of the holder 10 from the surface difficult or so strong as to remove the magnet strips 20 from the surface when the holder 10 is removed.

Once the magnet strips 20 are in place, the article holder 10 can be switched from notebook to notebook or notebook to desktop, etc. This provides an added convenience for the student or worker in that only one article holder 10 is needed for home, office, or school.

The length of fastening material 36 supplied with the article holder kit 8 may be trimmed to fit any desired implement to be detachably secured to the article holder. Once the user trims the length 36 into appropriately sized strips, the release liner 40 may be removed, and the small strips of fastening material 36 adhered to the implement. The user then may carry the articles 24 included in the kit 8 or his or her own articles or both with the article holder 10.

Any articles retained by the holder are held firmly in place but may be easily removed from the holder 10. When not in use, each article may be quickly and easily reattached to the holder by simply placing them on the holder 10 and aligning the fastening strips 34 located on the article with the fastening material 14 attached to the holder.

It is to be understood that the present invention is not limited to the sole embodiment described above, but encompasses any and all embodiments within the scope of the following claims.

I claim:

1. An article holder kit adapted to receive writing, drawing, and paper working articles thereon and for being detachably secured to a flat surface, the article holder kit comprising:

a) a predetermined number of elongated, thin permanent magnet strips, each having an adhesive backing and a release liner covering said adhesive backing, for attachment to a flat supporting surface;

b) a thin ferrous metal plate, dimensioned and configured to overlie said number of magnet strips;

c) a predetermined amount of first, upwardly directed fastening material adhesively attached to an upper face of said ferrous metal plate; and d) at least one, narrow, short length of second fastening material cooperating with said first fastening material, and having an adhesive backing and a release liner covering said adhesive backing, for attachment to an article, thus to detachably mount the article on said first fastener material and onto said metal plate.

2. The article holder kit according to claim 1, wherein said first amount of fastening material is provided in roll form, and is segmented into one or more short lengths, to be adhered to said ferrous metal plate.

3. The article holder kit according to claim 1, wherein said first and second fastening material are hook and loop fasteners.

4. The article holder kit according to claim 1, further comprising at least one thin, permanent magnet, article mounting strip having an adhesive backing and a release liner covering said adhesive backing, whereby said magnet article mounting strip may be adhered to an article and placed onto said metal plate, thus to temporarily, detachably, magnetically mount an article onto said metal plate.

5. An article holder kit adapted to receive writing, drawing, and paper working articles thereon and for being detachably secured to a flat surface, the article holder kit comprising:

a) a predetermined number of elongated, thin permanent magnet strips, each having an adhesive backing and a release liner covering said adhesive backing, for attachment to a flat supporting surface;

b) a thin ferrous metal plate, dimensioned and configured to overlie said number of magnet strips;

c) a predetermined number of first, upwardly directed fastening material segments adhesively attached to an upper face of said ferrous metal plate;

d) a predetermined number of narrow, short length, second fastening material strips cooperating with said first fastening material segments, each having an adhesive backing and a release liner covering said adhesive backing, for attachment to a number of articles, thus to detachably mount the articles on said first fastener material segments and onto said metal plate; and e) at least one thin, permanent magnet, article mounting strip having an adhesive backing and a release liner covering said adhesive backing, whereby said magnet article mounting strip may be adhered to an article and placed onto said metal plate, thus to temporarily, detachably, magnetically mount an article onto said metal plate.

* * * * *